US010302341B2

(12) United States Patent
Ogata et al.

(10) Patent No.: US 10,302,341 B2
(45) Date of Patent: May 28, 2019

(54) EJECTOR-INTEGRATED HEAT EXCHANGER

(71) Applicant: DENSO CORPORATION, Kariya, Aichi-pref. (JP)

(72) Inventors: Gouta Ogata, Kariya (JP); Yuichi Shirota, Kariya (JP); Hiroya Hasegawa, Kariya (JP); Tatsuhiro Suzuki, Kariya (JP); Makoto Ikegami, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 120 days.

(21) Appl. No.: 15/544,601

(22) PCT Filed: Jan. 21, 2016

(86) PCT No.: PCT/JP2016/000283
§ 371 (c)(1),
(2) Date: Jul. 19, 2017

(87) PCT Pub. No.: WO2016/125437
PCT Pub. Date: Aug. 11, 2016

(65) Prior Publication Data

US 2018/0087848 A1 Mar. 29, 2018

(30) Foreign Application Priority Data

Feb. 2, 2015 (JP) ..... 2015-018413
Aug. 19, 2015 (JP) ..... 2015-161620

(51) Int. Cl.
*F28F 3/08* (2006.01)
*F25B 39/02* (2006.01)
(Continued)

(52) U.S. Cl.
CPC ..... *F25B 39/022* (2013.01); *F25B 1/00* (2013.01); *F25B 5/04* (2013.01); *F25B 39/02* (2013.01);
(Continued)

(58) Field of Classification Search
CPC .... F25B 39/022; F25B 39/024; F25B 39/028; F25B 5/04; F25B 39/02; F25B 41/00;
(Continued)

(56) References Cited

U.S. PATENT DOCUMENTS 4,595,344 A * 6/1986 Briley ..... F04F 5/48 239/546
5,701,760 A * 12/1997 Torigoe ..... F25B 39/022 165/153
(Continued)

FOREIGN PATENT DOCUMENTS

DE 102006035880 A1 * 3/2007 ..... F25B 39/028
JP 5381875 B2 * 1/2014
JP 2014055765 A * 3/2014

*Primary Examiner* — Devon Russell
(74) *Attorney, Agent, or Firm* — Harness, Dickey & Pierce, P.L.C.

(57) ABSTRACT

An ejector-integrated heat exchanger includes multiple tube forming members. The tube forming member includes an ejector, a flow-out side refrigerant passage, and a suction side refrigerant passage. The ejector includes a nozzle portion decompressing a refrigerant, a refrigerant suction port, and a pressure increasing portion in which the refrigerant drawn from the refrigerant suction port and the refrigerant jetted from the nozzle portion are mixed, a pressure of the mixed refrigerant being increased in the pressure increasing portion. In the flow-out side refrigerant passage, the refrigerant flowing out of the pressure increasing portion performs heat exchange while flowing. In the suction side refrigerant passage, the refrigerant that is to be drawn through the refrigerant suction port performs heat exchange
(Continued)

while flowing. Multiple tube forming members are arranged such that the refrigerant flows in parallel with each other.

16 Claims, 13 Drawing Sheets

(51) Int. Cl.

| | |
|---|---|
| ***F25B 41/00*** | (2006.01) |
| ***F28F 9/02*** | (2006.01) |
| ***F28D 1/03*** | (2006.01) |
| ***F28D 9/00*** | (2006.01) |
| ***F25B 1/00*** | (2006.01) |
| ***F25B 5/04*** | (2006.01) |

(52) U.S. Cl.
CPC ..... *F25B 41/00* (2013.01); *F28D 1/03* (2013.01); *F28D 1/0341* (2013.01); *F28D 9/0043* (2013.01); *F28F 3/08* (2013.01); *F28F 9/0246* (2013.01); *F28F 9/0263* (2013.01); *F28F 9/0265* (2013.01); *F25B 2341/0011* (2013.01); *F25B 2400/0407* (2013.01); *F25B 2500/18* (2013.01); *F25B 2600/2501* (2013.01)

(58) Field of Classification Search
CPC ..... F25B 2600/2501; F25B 2400/0407; F28F 3/08; F28F 3/086; F28F 9/0263; F28D 1/03; F28D 1/0341; F28D 1/0325; F28D 9/0043; F28D 9/0263
See application file for complete search history.

(56) References Cited

U.S. PATENT DOCUMENTS

| | | | | |
|---|---|---|---|---|
| 5,931,020 | A * | 8/1999 | Nakamura | F25B 39/022 165/146 |
| 6,742,577 | B2 * | 6/2004 | Joboji | F28D 1/0333 165/153 |
| 2007/0169512 | A1 * | 7/2007 | Ishizaka | F25B 5/04 62/515 |
| 2008/0314074 | A1 * | 12/2008 | Nakamura | F25B 41/00 62/500 |
| 2009/0107171 | A1 * | 4/2009 | Brodie | F25B 39/02 62/500 |
| 2010/0175422 | A1 * | 7/2010 | Yamada | F25B 41/00 62/512 |
| 2011/0048064 | A1 * | 3/2011 | Ota | F25B 39/022 62/500 |
| 2011/0120182 | A1 * | 5/2011 | Haussmann | F25B 39/022 62/524 |
| 2011/0259042 | A1 * | 10/2011 | Nishino | F28D 1/0333 62/527 |
| 2015/0168047 | A1 * | 6/2015 | Danjyo | F28D 1/05383 62/467 |

* cited by examiner

EJECTOR-INTEGRATED HEAT EXCHANGER

CROSS REFERENCE TO RELATED APPLICATIONS

This application is a U.S. National Phase Application under 35 U.S.C. 371 of International Application No. PCT/JP2016/000283 filed on Jan. 21, 2016 and published in Japanese as WO 2016/125437 Al on Aug. 11, 2016. This application is based on and claims the benefit of priority from Japanese Patent Applications No. 2015-018413 filed on Feb. 2, 2015, and No. 2015-161620 filed on Aug. 19, 2015. The entire disclosures of all of the above applications are incorporated herein by reference.

TECHNICAL FIELD

The present disclosure relates to an ejector-integrated heat exchanger used in an ejector refrigeration cycle.

BACKGROUND ART

Patent Document 1 discloses an ejector refrigeration cycle including an ejector, a flow-out side evaporator, and an suction side evaporator. In the ejector refrigeration cycle, both the flow-out side evaporator and the suction side evaporator exert a heat absorbing function.

The ejector works as a refrigerant decompression device. The flow-out side evaporator evaporates a refrigerant flowing out of a diffuser portion of the ejector. The suction side evaporator evaporates the refrigerant drawn into the ejector from a refrigerant suction port.

In this ejector refrigeration cycle, since a refrigerant evaporation pressure (refrigerant evaporation temperature) in the flow-out side evaporator can be higher than the refrigerant evaporation pressure in the suction side evaporator by pressure increasing effect of the diffuser portion, the refrigerant can be evaporated at different temperature in each evaporator. Moreover, since the refrigerant flowing out of the flow-out side evaporator is drawn into the compressor, the pressure of the refrigerant drawn into the compressor is increased, and accordingly power consumption of the compressor can be reduced.

Patent Document 1 further discloses an evaporator unit in which the ejector, the flow-out side evaporator, and the suction side evaporator are integrated with each other.

According to this evaporator unit, since the connections between the ejector and the other components constituting the cycle can be simplified, mountability of the ejector refrigeration cycle to a product such as a cooling device or refrigeration device can be improved.

Further, in the evaporator unit of Patent Document 1, the flow-out side evaporator and the suction side evaporator are arranged in series regarding the air flow that is a cooling target fluid such that the air sent to the cooling target space that is in common between both evaporators can be cooled by both evaporators.

PRIOR ART DOCUMENT

Patent Document

Patent Document 1: JP No. 5381875

SUMMARY OF THE INVENTION

However, according to a study by the inventors of the present disclosure, since the ejector refrigeration cycle of Patent Document 1 includes one ejector corresponding to a pair of the flow-out side evaporator and the suction side evaporator, a change of the design of the ejector is required according to the sizes of the suction side evaporator and the flow-out side evaporator (in the other words, heat exchange capacity). This may cause an increase of variety of the evaporator to be difficult.

For example, since a flow amount of the refrigerant varies depending on the size of the evaporator, a diameter of a nozzle of the ejector is required to be changed according to the flow amount of the refrigerant.

When the number of tubes of the suction side evaporator increases, it may become difficult that the ejector equally draws the refrigerant from all tubes. In this case, a temperature distribution is generated in the suction side evaporator, the capacity of the evaporator decreases, and accordingly the coefficient of performance (COP) of the refrigeration cycle may decrease. In order to avoid this, the refrigerant drawing capacity of the ejector is necessary to be changed depending on the number of the tubes of the suction side evaporator.

In consideration of the above-described points, it is an objective of the present disclosure to provide an ejector-integrated heat exchanger whose variety can be increased easily.

An ejector-integrated heat exchanger according to an aspect of the present disclosure includes an ejector including: a nozzle portion that decompresses a refrigerant; a refrigerant suction port, the refrigerant drawn through the refrigerant suction port due to a flow of the refrigerant jetted from the nozzle portion; and a pressure increasing portion in which the refrigerant drawn through the refrigerant suction port and the refrigerant jetted from the refrigerant suction port are mixed, a pressure of the mixed refrigerant is increased in the pressure increasing portion. The ejector-integrated heat exchanger includes multiple tube forming members each including: a flow-out side refrigerant passage in which the refrigerant flowing out of the pressure increasing portion performs heat exchange while flowing; and a suction side refrigerant passage in which the refrigerant that is to be drawn through the refrigerant suction port performs heat exchange while flowing. The refrigerant in the tube forming members flows in parallel with each other.

According to this, since the ejector is provided in each tube forming member, the number of the ejector changes depending on the number of the tube forming member that changes depending on a type of a heat exchanger.

In other words, when the number of the flow-out side refrigerant passage and the number of the suction side refrigerant passage change, the sizes of the nozzle and a refrigerant suction capacity of the ejector as a whole also change.

Accordingly, since a decrease of performance of coefficient of performance (COP) can be limited even when the design of the ejector is commonized between different varieties of the ejector, the variety of the heat exchanger can be increased easily.

EMBODIMENTS FOR EXPLOITATION OF THE INVENTION

Figure 1:
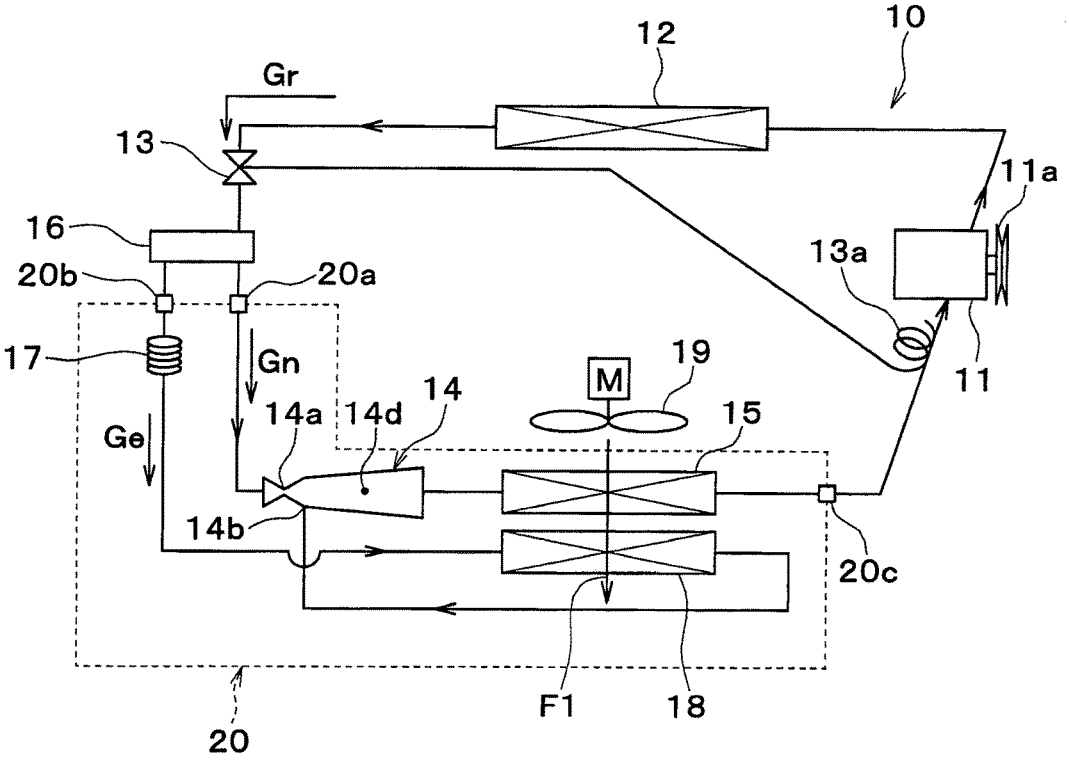
FIG. 1 is a diagram illustrating a whole structure of an ejector refrigeration cycle according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Embodiments will be described below referring to the drawings. In the respective embodiments, a part that corresponds to a matter described in a preceding embodiment may be assigned the same reference numeral.

(First Embodiment)

FIG. 1 shows an example where an ejector refrigeration cycle 10 is used in a refrigeration cycle device for a vehicle. In the ejector refrigeration cycle 10, a compressor 11 is driven and rotated by an engine for vehicle travel through an electromagnetic clutch 11*a* and a belt, for example.

A variable volume compressor that is capable of adjusting a refrigerant discharge capacity by changing a discharge amount or a fixed volume compressor that is capable of adjusting the refrigerant discharge capacity by changing the availability ratio through making the electromagnetic clutch 11*a* off and on may be used as the compressor 11. When an electric compressor is used as the compressor 11, the refrigerant discharge capacity can be adjusted by adjusting a rotation speed of an electric motor.

A radiator 12 is disposed on a refrigerant discharge side of the compressor 11. The radiator 12 performs a heat exchange between a high-pressure refrigerant discharged by the compressor 11 and an outside air (vehicle exterior air) blown by a cooling fan to cool the high-pressure refrigerant.

In the present embodiment, a refrigerant whose pressure does not excess a critical pressure such as chlorofluorocarbon or hydrocarbon refrigerant is used, and the ejector refrigeration cycle 10 constitutes a vapor-compression subcritical cycle. Accordingly, the radiator 12 works as a condenser that condenses a refrigerant.

A thermostatic expansion valve 13 is disposed on an outlet side of the radiator 12. The thermostatic expansion valve 13 decompresses the liquid-phase refrigerant from the radiator 12 and has a thermostatic portion 13*a* located in an intake side passage of the compressor 11.

The thermostatic expansion valve 13 detects a degree of superheat of the refrigerant on an intake side (the refrigerant on an outlet side of the evaporator) of the compressor based on temperature and pressure of the refrigerant on the intake side of the compressor 11, and the thermostatic expansion valve 13 adjusts an opening degree of an valve (refrigerant amount) such that the degree of superheat of the refrigerant on the intake side of the compressor becomes a predetermined value.

An ejector 14 is disposed on an outlet side of the thermostatic expansion valve 13. The ejector 14 is a decompression device decompressing the refrigerant and is a refrigerant circulation device (kinetic pump) that circulates the refrigerant by a drawing effect (sucking effect) of a flow of the refrigerant jetted at high speed.

In FIG. 1, only one ejector 14 is illustrated on the grounds of expediency of the drawing, but multiple ejectors 14 are disposed in parallel with regard to a flow of the refrigerant.

The ejector 14 includes a nozzle portion 14*a* and a refrigerant suction port 14*b*. The nozzle portion 14*a* throttles an area of a passage of the refrigerant (intermediate-pressure refrigerant) that has passed the thermostatic expansion valve 13 to further decompress and expand the refrigerant. The refrigerant suction port 14*b* is disposed in the same space as a refrigerant discharge port of the nozzle portion 14*a* and draws the vapor-phase refrigerant flowing from an suction side refrigerant passage 18.

A diffuser portion 14*d* is positioned downstream of the nozzle portion 14*a* and the refrigerant suction port 14*b* with regard to the flow of the refrigerant. The diffuser portion 14*d* is a pressure increasing portion that mixes the high-velocity flow of the refrigerant from the nozzle portion 14*a* and the intake refrigerant drawn from the refrigerant suction port 14*b* to increase pressure of the refrigerant.

The diffuser portion 14*d* has a shape in which an area of the passage of the refrigerant gradually increases, and the diffuser portion 14*d* decelerates the flow of the refrigerant to increase the pressure of the refrigerant. That is, the diffuser portion 14*d* converts a velocity energy of the refrigerant to a pressure energy.

A flow-out side refrigerant passage 15 is connected to an outlet portion (a front end portion of the diffuser portion 14*d*) side of the ejector 14. The flow-out side refrigerant passage 15 is a refrigerant passage in which the refrigerant flowing out of the diffuser portion 14*d* flows and performs a heat exchange.

An outlet side of the flow-out side refrigerant passage 15 is connected to an intake side of the compressor 11. In FIG. 1, only one flow-out side refrigerant passage 15 is illustrated on the grounds of expediency of the drawing, but multiple flow-out side refrigerant passages are disposed in parallel with regard to the flow of the refrigerant.

On an outlet side of the thermostatic expansion valve 13, a refrigerant distributor 16 that adjusts a refrigerant amount Gn flowing into the nozzle portion 14*a* of the ejector 14 and a refrigerant amount Ge flowing into the refrigerant suction port 14*b* of the ejector 14.

The refrigerant distributor 16 distributes the refrigerant that has passed the thermostatic expansion valve 13 to an inlet side of the nozzle portion 14*a* of the ejector 14 and an inlet side of the refrigerant suction port 14*b* of the ejector 14. The refrigerant distributor 16 has a vapor-liquid separation function and separates the refrigerant that has passed the thermostatic expansion valve 13 into a gas-liquid two-phase refrigerant flow flowing to the nozzle portion 14*a* of the ejector 14 and a liquid-phase refrigerant flow flowing to a throttle device 17.

The throttle device 17 and the suction side refrigerant passage 18 are located between the refrigerant distributor 16 and the refrigerant suction port 14*b* of the ejector 14. The throttle device 17 is a decompression device that adjusts a flow amount of the refrigerant flowing to the suction side refrigerant passage 18 and is located on an inlet side of the suction side refrigerant passage 18. The throttle device 17 has a nozzle shape.

The refrigerant drawn into the refrigerant suction port 14*b* of the ejector 14 flows and performs heat exchange in the suction side refrigerant passage 18.

In FIG. 1, only one suction side refrigerant passage 18 is illustrated on the grounds of expediency of the drawing, but multiple suction side refrigerant passage 18 are disposed in parallel with regard to a flow of the refrigerant.

Multiple ejectors 14, multiple flow-out side refrigerant passages 15, the throttle devices 17 and multiple suction side refrigerant passages 18 are integrated to constitute one evaporator 20 (ejector-integrated heat exchanger).

The evaporator 20 and an electric blower 19 are accommodated in a casing. In the casing, an air passage is defined. An air (cooling target air) is blown by the electric blower 19 in the air passage as indicated by an arrow F1 to be cooled by the evaporator 20.

The cooled air that is cooled by the evaporator 20 is sent to a cooling target space. Therefore, the cooling target space is cooled by the evaporator 20.

The flow-out side refrigerant passage 15 and the suction side refrigerant passage 18 are aligned in a flow direction of the air sent to the cooling target space. Specifically, the flow-out side refrigerant passage 15 that is connected to a main passage located downstream of the ejector 14 is located on an upstream side (windward side) with regard to an airflow F1, and the suction side refrigerant passage 18 that is connected to the refrigerant suction port 14*b* of the ejector 14 is located on a downstream side (leeward side) with regard to the airflow F1.

The evaporator 20 includes an ejector side refrigerant inlet 20*a* and a throttle device side refrigerant inlet 20*b* which are inlets for the refrigerant and a refrigerant outlet 20*c*. The ejector side refrigerant inlet 20*a* communicates with the nozzle portion 14*a* of the ejector 14. The throttle device side refrigerant inlet 20*b* communicates with the throttle device 17. The refrigerant outlet 20*c* communicates with the flow-out side refrigerant passage 15.

A specific example of the evaporator 20 will be described referring FIGS. 2 through 6. In the drawings, an up-down arrow indicates an up-down direction of a vehicle in a condition where the evaporator 20 is installed in the vehicle.

Figure 2:
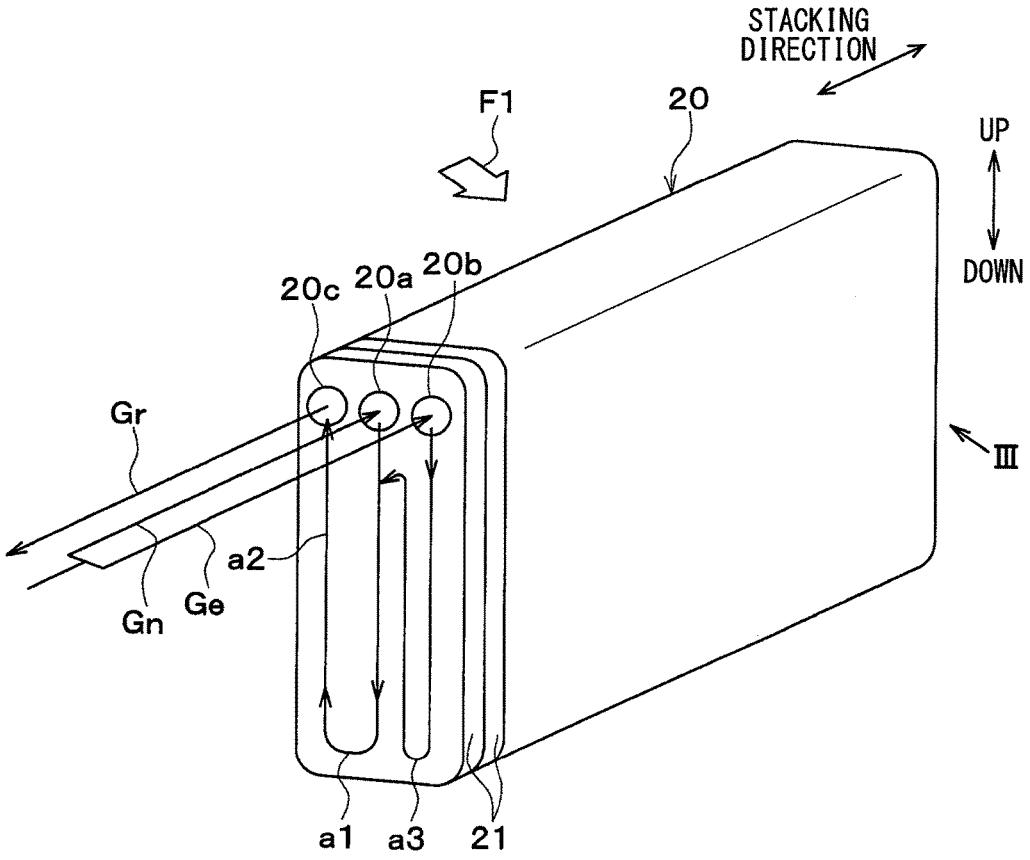
FIG. 2 is a perspective view illustrating an evaporator according to the first embodiment.

The evaporator 20 includes multiple tube forming members (first members) 21 which are stacked with each other. In each tube forming member 21, the ejector 14, the flow-out side refrigerant passage 15, the throttle device 17, and the suction side refrigerant passage 18 are defined. A cross-sectional shape of the tube forming member 21 is flat along the airflow direction F1. In FIG. 2, only two tube forming members 21 are illustrated on the grounds of expediency of the drawing, but multiple tube forming members 21 are stacked in a stacking direction.

The ejector side refrigerant inlet 20*a*, the throttle device side refrigerant inlet 20*b*, and the refrigerant outlet 20*c* of the evaporator 20 are provided in one tube forming member 21 of multiple tube forming members 21 positioned at one end in the stacking direction.

The tube forming member 21 includes one holed member 211 and two closing members 212, 213. The holed member 211 is a flat plate member that includes a hole corresponding to the ejector 14, the flow-out side refrigerant passage 15, throttle device 17, and the suction side refrigerant passage 18. The closing members 212, 213 are flat plate members that close the hole of the holed member 211 from both sides of the holed member 211.

Figure 4:
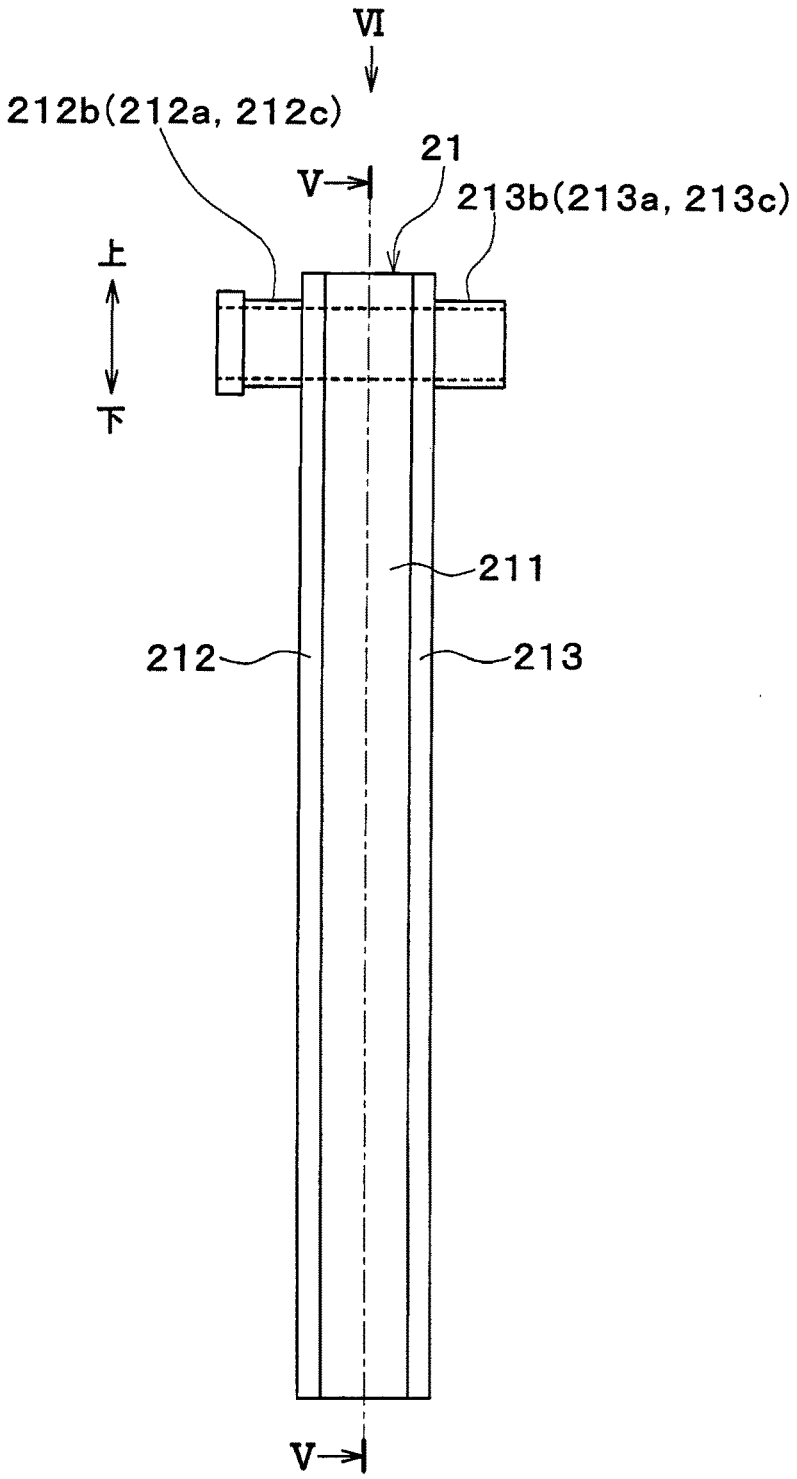
FIG. 4 is a front view illustrating a tube forming member according to the first embodiment.
Figure 5:
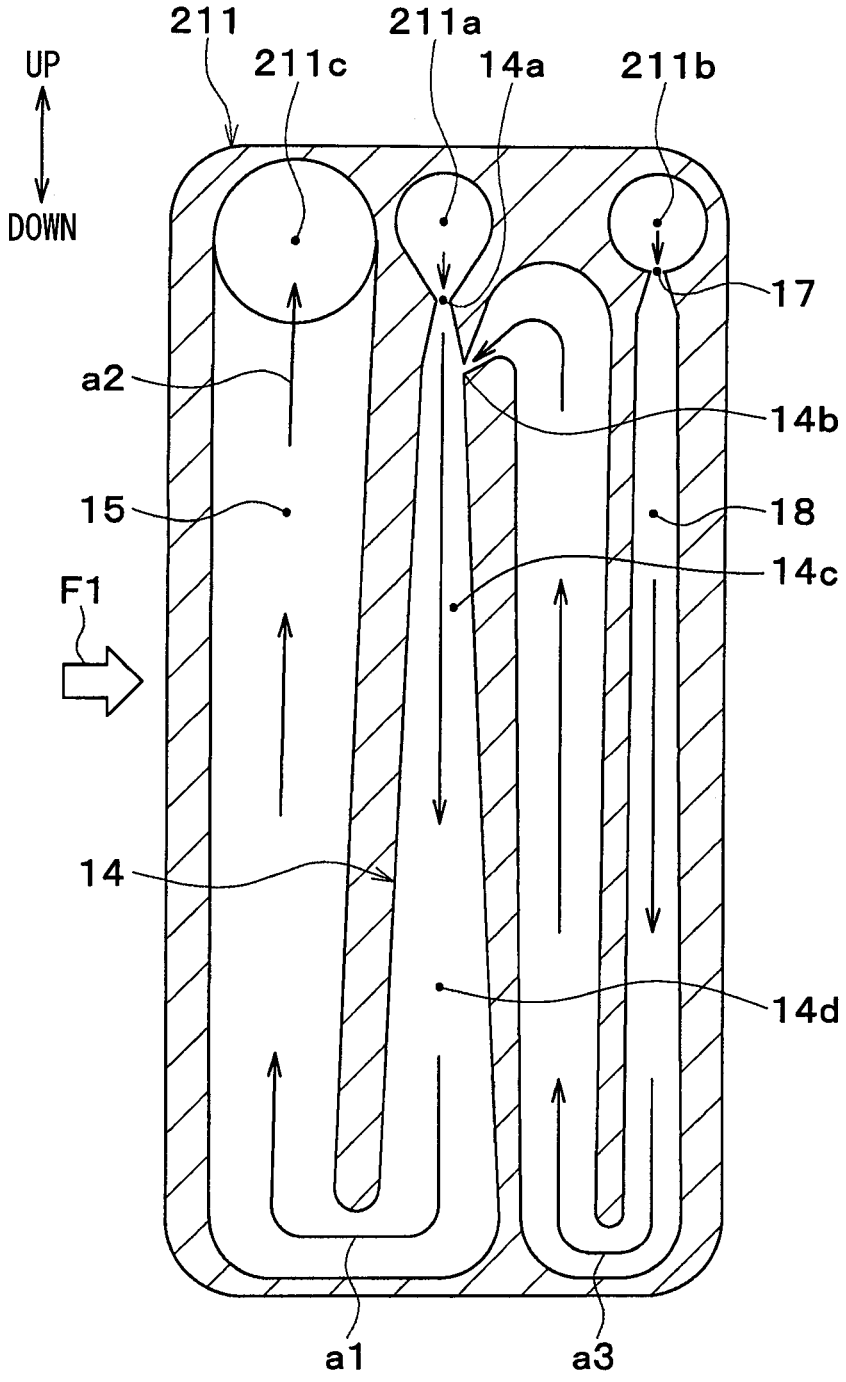
FIG. 5 is a sectional diagram taken along V-V line in FIG. 4.

The holed member 211 and the closing members 212, 213 have rectangular plate shapes whose longitudinal direction is a direction perpendicular to the airflow direction F1 (up-down direction of FIGS. 4, 5).

The tube forming member 21 is constituted by stacking the holed member 211 and the closing members 212, 213 with each other.

An ejector side inlet tank hole 211*a*, a throttle device side inlet tank hole 211*b*, and an outlet tank hole 211*c* are formed at one end portion in the longitudinal direction of the holed member 211.

The ejector side inlet tank hole 211*a* is connected to the nozzle portion 14*a* of the ejector 14. The throttle device side inlet tank hole 211*b* is connected to the throttle device 17. The outlet tank hole 211*c* is connected to the flow-out side refrigerant passage 15.

In the ejector 14, the nozzle portion 14*a* is positioned on one end side (upper side of FIG. 5) in the longitudinal direction of the holed member 211, and the diffuser portion 14*d* is positioned on the other end side (lower side of FIG. 5) in the longitudinal direction of the holed member 211.

The diffuser portion 14*d* of the ejector 14 is communicated with the flow-out side refrigerant passage 15 on the other end side in the longitudinal direction of the holed member 211. The flow-out side refrigerant passage 15 extends from the other end side toward the one end side in the longitudinal direction of the holed member 211 to be communicated with the outlet tank hole 211*c*.

The suction side refrigerant passage 18 extends from the throttle device 17 toward the other end side in the longitudinal direction of the holed member 211 and is curved like U-turn toward the one end side in the longitudinal direction of the holed member 211 to be communicated with the refrigerant suction port 14*b* of the ejector 14.

The ejector 14 is positioned between the flow-out side refrigerant passage 15 and the suction side refrigerant passage 18.

The flow-out side refrigerant passage 15 and the suction side refrigerant passage 18 gradually increase passage areas (cross-sectional area of passage).

Figure 3:
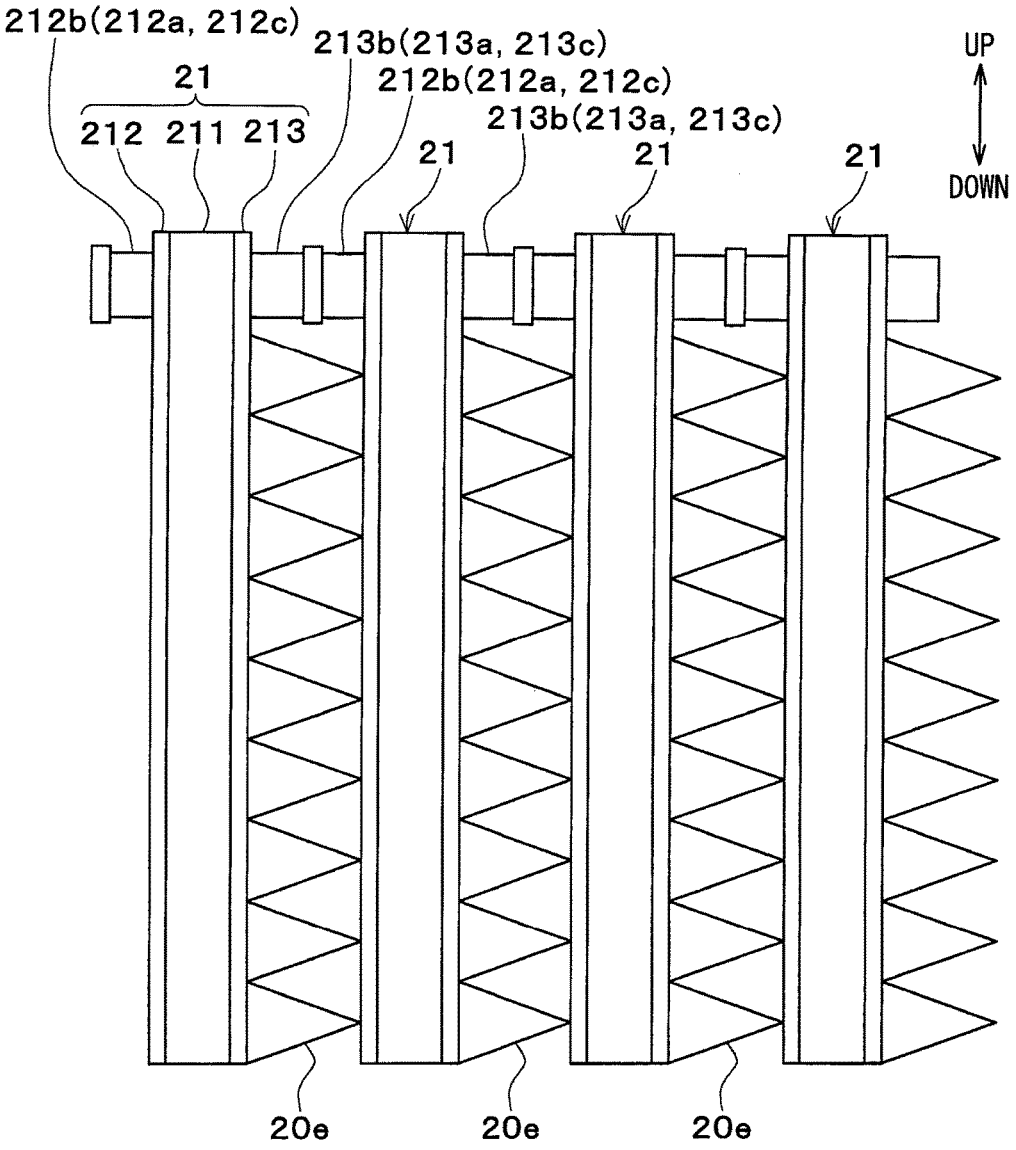
FIG. 3 is a diagram illustrating the evaporator viewed along an arrow III of FIG. 2.
Figure 6:
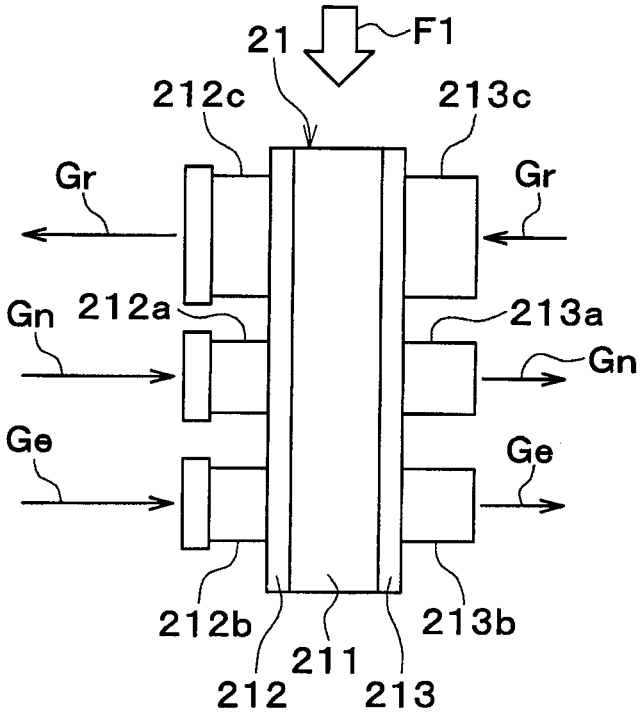
FIG. 6 is a diagram illustrating the tube forming member viewed along an arrow VI of FIG. 4.

As shown in FIGS. 3, 4 and 6, the closing members 212, 213 include ejector side pipe portions 212*a*, 213*a*, throttle device side pipe portions 212*b*, 213*b*, and outlet side pipe portions 212*c*, 213*c*.

These pipe portions 212*a*, 213*a*, 212*b*, 213*b*, 212*c*, 213*c* are formed integrally with the closing members 212, 213 by burring.

Ends of the pipe portions 212*a*, 212*b*, 212*c* of the closing member 212 are enlarged. The pipe portions 213*a*, 213*b*, 213*c* of the closing member 213 are inserted into and joined to the enlarged ends of the pipe portions 212*a*, 212*b*, 212*c*. Accordingly, the pipe portions 212*a*, 213*a*, 212*b*, 213*b*, 212*c*, 213*c* work as a connection portions which join the tube forming members 21 next each other.

The ejector side pipe portions 212*a*, 213*a* overlap the ejector side inlet tank hole 211*a* of the holed member 211. Accordingly, the ejector side pipe portions 212*a*, 213*a* work as communication portions which cause the ejector side inlet tank holes 211*a* of tube forming members 21 next to each other to communicate with each other.

The ejector side pipe portions 212*a*, 213*a* and the ejector side inlet tank hole 211*a* constitute a distribution tank that distributes the refrigerant to the nozzle portion of the ejector 14 of each tube forming portion 21.

The throttle device side pipe portions 212*b*, 213*b* overlap the throttle device side inlet tank hole 211*b* of the holed member 211. Accordingly, the throttle device side pipe portions 212*b*, 213*b* work as communication portions which cause the throttle device side inlet tank holes 211*b* of tube forming members 21 next to each other to communicate with each other.

The throttle device side pipe portions 212*b*, 213*b* and the throttle device side inlet tank hole 211*b* constitute a distribution tank that distributes the refrigerant to the throttle device 17 and the suction side refrigerant passage 18 of each tube forming member 21.

The outlet side pipe portions 212*c*, 213*c* overlap the outlet tank hole 211*c* of the holed member 211. Accordingly, the outlet side pipe portions 212*c*, 213*c* work as communication portions which cause the outlet tank holes 211*c* of tube forming members 21 next to each other to communicate with each other.

The outlet pipe portions 212*c*, 213*c* and the outlet tank hole 211*c* constitute a collection tank that collects the refrigerant flowing from the flow-out side refrigerant passage 15 of each tube forming member 21.

Between multiple tube forming members 21, fins 20*e* that are connected to the tube forming members 21 are provided. The air blown by the electric blower 19 passes gap portions of a stacking structure of the tube forming members 21 and the fins 20*e*.

The fin 20*e* is a heat exchange enhancing member that enhances a heat exchange between the refrigerant and the air. The fin 20*e* is a corrugated fin that is formed by bending a thin plate material into a wavy shape, and the fin 20*e* is connected to an outer surface of the tube forming member 21 that is flat to increase a heat exchange area of the air side. The evaporator 20 may be a heat exchanger that does not include the fin 20*e*.

An upstream side heat exchange core and a downstream side heat exchange core which cause the refrigerant and the air to exchange heat are provided by the stacking structure of multiple tube forming members 21 and the fins 20*e*.

The upstream side heat exchange core includes the flow-out side refrigerant passage 15 and is positioned on an upstream side of the evaporator 20 with regard to the airflow F1. The downstream side heat exchange core includes the suction side refrigerant passage 18 and constitutes a downstream area of the evaporator 20 with regard to the airflow F1.

Aluminum that is a metal superior in thermal conductivity and a property for brazing is preferable as a material of the holed member 211, the closing members 212, 213, and the fin 20*e*. When the members are made of aluminum, the whole structure of the evaporator 20 can be integrally formed by brazing.

The refrigerant passages of the evaporator 20 having the above-described structure will be specifically described below referring to FIGS. 2, 5.

The vapor-liquid two-phase refrigerant flowing into the ejector side inlet tank hole 211*a* from the ejector side refrigerant inlet 20*a* flows to the nozzle portion 14*a* of the ejector 14 and passes through the ejector 14 to be decompressed. The low-pressure refrigerant that has been decompressed flows into the flow-out side refrigerant passage 15 as indicated by an arrow a1. The refrigerant in the flow-out side refrigerant passage flows to the outlet tank hole 211*c* as indicated by an arrow a2 and flows out from the refrigerant outlet 20*c*. The vapor-liquid two-phase refrigerant may flow in the nozzle portion 14*a*, a mixing portion 14*c*, and the diffuser portion 14*d*, in this order.

The liquid-phase refrigerant flowing from the throttle device side refrigerant inlet 20*b* into the throttle device side inlet tank hole 211*b* flows to the throttle device 17 and passes through the throttle device 17 to be decompressed, and the decompressed low-pressure refrigerant (vapor-liquid two-phase refrigerant) flows into the suction side refrigerant passage 18.

The refrigerant flowing in the suction side refrigerant passage 18 curves like U-turn as indicated by an arrow a3 and is drawn into the ejector 14 from the refrigerant suction port 14*b*.

Next, actuations of the first embodiment will be described. When the compressor 11 is driven by an engine of a vehicle, the high-temperature and high-pressure refrigerant that is compressed and discharged by the compressor 11 flows into the radiator 12. The high-temperature refrigerant is cooled by the outside air to be condensed in the radiator 12. The high-pressure refrigerant flowing out of the radiator 12 passes the thermostatic expansion valve 13.

In the thermostatic expansion valve 13, an opening degree of the valve is adjusted such that a degree of superheat of the refrigerant becomes to be a predetermined value at the outlet of the flow-out side refrigerant passage 15, and the high-pressure refrigerant is decompressed. The refrigerant (intermediate pressure refrigerant) that has passed the thermostatic expansion valve 13 is separated into a main flow that flows into the ejector side refrigerant inlet 20*a* of the evaporator 20 and a branched flow that flows into the throttle device side refrigerant inlet 20*b*.

The refrigerant flowing into the ejector side refrigerant inlet 20*a* is decompressed to expand at the nozzle portion 14*a*. Accordingly, the pressure energy of the refrigerant is converted into the velocity energy at the nozzle portion 14*a* and jetted from an ejection hole of the nozzle portion 14*a* at high speed. The branched refrigerant (vapor-phase refrigerant) that has passed the suction side refrigerant passage 18 is drawn from the refrigerant suction port 14*b* by a pressure decrease caused by a flow of the high-speed jetted refrigerant.

The refrigerant jetted from the nozzle portion 14*a* and the refrigerant drawn from the refrigerant suction port 14*b* are mixed in the mixing portion 14*c* positioned downstream of the nozzle portion 14*a* and flows into the diffuser portion 14*d*. Since the passage area of the diffuser portion 14*d* increases, the velocity (expansion) energy of the refrigerant is converted to the pressure energy, and accordingly the refrigerant pressure increases.

The refrigerant flowing out of the diffuser portion 14*d* of the ejector 14 flows in the flow-out side refrigerant passage 15. In the flow-out side refrigerant passage 15, the low-temperature and low-pressure refrigerant absorbs heat from the blown air flowing in the direction of the arrow F1 and is evaporated. The vapor-phase refrigerant that has been evaporated is drawn from one refrigerant outlet 20*c* into the compressor 11 to be compressed again.

On the other hand, the branched refrigerant flowing into the throttle device side refrigerant inlet 20*b* is decompressed by the throttle device 17 to become the low-pressure refrigerant (vapor-liquid two-phase refrigerant), and the low-pressure refrigerant flows in the suction side refrigerant passage 18. In the suction side refrigerant passage 18, the low-temperature and low-pressure refrigerant absorbs heat from the blown air that has passed the flow-out side refrigerant passage 15 to be evaporated. The vapor-phase refrigerant that has been evaporated is drawn from the refrigerant suction port 14*b* into the ejector 14.

As described above, the refrigerant flowing downstream of the diffuser portion 14*d* of the ejector 14 can be supplied to the flow-out side refrigerant passage 15, and the branched refrigerant can be supplied to the suction side refrigerant passage 18 through the throttle device 17, and accordingly the cooling effects can be obtained in the flow-out side refrigerant passage 15 and the suction side refrigerant passage 18 simultaneously. Accordingly, the cool air that has cooled by both the flow-out side refrigerant passage 15 and the suction side refrigerant passage 18 is blown to the cooling target space to cool the cooling target space.

At this time, the pressure of the refrigerant evaporated in the flow-out side refrigerant passage 15 is the pressure after increased by the diffuser portion 14*d*. Since the outlet side of the suction side refrigerant passage 18 is connected to the refrigerant suction port 14*b* of the ejector 14, the lowest pressure of the refrigerant immediately after decompressed by the nozzle portion 14*a* can affect the suction side refrigerant passage 18.

According to this, the evaporation pressure (evaporation temperature) at which the refrigerant is evaporated in the suction side refrigerant passage 18 can be lower than the evaporation pressure (evaporation temperature) at which the refrigerant is evaporated in the flow-out side refrigerant passage 15. The flow-out side refrigerant passage 15 that has the higher evaporation temperature is located on the upstream side with regard to the airflow direction F1, and the suction side refrigerant passage 18 that has the lower evaporation temperature is located on the downstream side with regard to the airflow direction F1. Accordingly, both a temperature difference between the evaporation temperature of the refrigerant in the flow-out side refrigerant passage 15 and the blown air, and a temperature difference between the evaporation temperature of the refrigerant in the suction side refrigerant passage 18 and the blown air can be secured.

Therefore, both the flow-out side refrigerant passage (first evaporation passage) 15 and the suction side refrigerant passage (second evaporation passage) 18 are capable of exert cooling capacities effectively. Accordingly, the cooling capacity for cooling the cooling target space can be effectively improved by the combination of the first and second evaporation passage 15, 18. Moreover, since the pressure of the refrigerant drawn into the compressor 11 is increased by the pressure increase effect of the diffuser portion 14*d*, the driving power of the compressor 11 can be reduced.

According to the present embodiment, since the refrigerant passage that guides the refrigerant flowing out of the ejector 14 to the flow-out side refrigerant passage 15 (flow-out side evaporator) is formed in the evaporator 20 without refrigerant pipes, the evaporator 20 can be downsized, and a pressure loss of the refrigerant whose pressure is increased by the diffuser portion 14*d* can be limited. As a result, a coefficient of performance (COP) of the cycle can be sufficiently improved by the ejector 14. In other words, COP can be sufficiently improved by reducing the driving power used by the compressor.

In the present embodiment, the flow-out side refrigerant passage 15, the suction side refrigerant passage 18, and the ejector 14 are formed in each of multiple tube forming members 21 in which the refrigerant flows in parallel with each other.

According to this, the number of the ejector 14 increases and decreases depending on the change of the number of the tube forming member 21 that is changed according to the type of the evaporator 20. In other words, when the number of the flow-out side refrigerant passage 15 and the number of the suction side refrigerant passage 18 is changed, the size of the nozzle of the ejector 14 and a refrigerant drawing capacity of the whole of the evaporator 20 are also changed.

Accordingly, even if the design of the ejector 14 is commonized between other types of evaporator 20, decrease of the performance and coefficient of performance can be limited, and accordingly the variety of the evaporator 20 can be easily increased.

In other words, since it is enough to optimize the ejector 14 of one tube forming member 21, the variety of the evaporator 20 can be easily increased.

For example, when a small capacity is required for the evaporator 20, the evaporator 20 is small. When a large capacity is required for the evaporator 20, the evaporator 20 is large. In the present embodiment, since the number of the tube forming member 21 increases according to the increase of the size of the evaporator 20, the number of the ejector 14 also increases, and accordingly the size of the nozzle and the refrigerant suction capacity also increase as a whole. Therefore, the ejector 14 is not needed to be optimized depending on the size of the evaporator 20.

Moreover, since the number of the ejector 14 used in one evaporator 20 is large, the number of the ejector 14 manufactured is increased, and accordingly the cost for manufacturing the ejector 14 can be reduced.

Furthermore, since the ejector 14 is provided inside the evaporator 20, the mountability of the ejector refrigeration cycle 10 to a product can be improved.

In the present embodiment, the sectional areas of the flow-out side refrigerant passage 15 and the suction side refrigerant passage 18 increase toward the downstream side of the refrigerant.

According to this, since the sectional areas of the flow-out side refrigerant passage 15 and the suction side refrigerant passage 18 increase as the refrigerant evaporates to increase its volume in the flow-out side refrigerant passage 15 and the suction side refrigerant passage 18, the increase of the pressure loss caused by the evaporation of the refrigerant can be limited.

In the present embodiment, the pipe portions 212*a*, 212*b*, 212*c* provided in one of a pair of the tube forming members 21 next to each other have the enlarged end portions. The pipe portions 212*a*, 212*b*, 212*c* of the other one of the pair of the tube forming members 21 are inserted into the enlarged end portions. Accordingly, multiple tube forming members 21 can be easily connected to each other.

In the present embodiment, the tube forming member 21 includes the throttle device 17. The throttle device 17 has a nozzle shape that throttles the flow of the refrigerant flowing into the suction side refrigerant passage 18.

According to this, since the throttle device 17 can be included in the tube forming member 21, the number of components can be reduced, and accordingly the configuration of the refrigeration cycle as a whole can be simplified. Moreover, since multiple throttle devices 17 are provided in the evaporation as a whole, the refrigeration cycle is not stopped even when any one of the throttle devices 17 is blocked.

Since the throttle device 17 has a nozzle shape, the throttle device 17 can have characteristics as a nozzle similar to the nozzle portion 14*a* of the ejector 14. Accordingly, a proportion of the flow amount of the refrigerant flowing through the throttle device 17 and the nozzle portion 14*a* can be easily set.

In the present embodiment, the tube forming member 21 includes the ejector 14 between the flow-out side refrigerant passage 15 and the suction side refrigerant passage 18. According to this, the ejector 14 can be formed in the tube forming member 21 such that the size of the tube forming member 21 is not increased in size as much as possible.

In the present embodiment, the tube forming member 21 is formed by integrating the holed member 211 that has the hole corresponding to the ejector 14, the flow-out side refrigerant passage (first refrigerant passage) 15, and the suction side refrigerant passage (second refrigerant passage) 18 with the closing members 212, 213 that close the hole of the holed member 211 from both sides of the holed member 211.

According to this, since the ejector 14 is formed in a flat shape, manufacturing accuracy of the ejector 14 can be easily increased. For example, manufacturing a part of the ejector 14 which requires high accuracy in coaxiality can be facilitated. Moreover, large amount of the tube forming members 21 can be manufactured cheaply by punching, for example.

(Second Embodiment)

In the present embodiment, a refrigerant distributor 16 is integrated with an evaporator 20.

Figure 7:
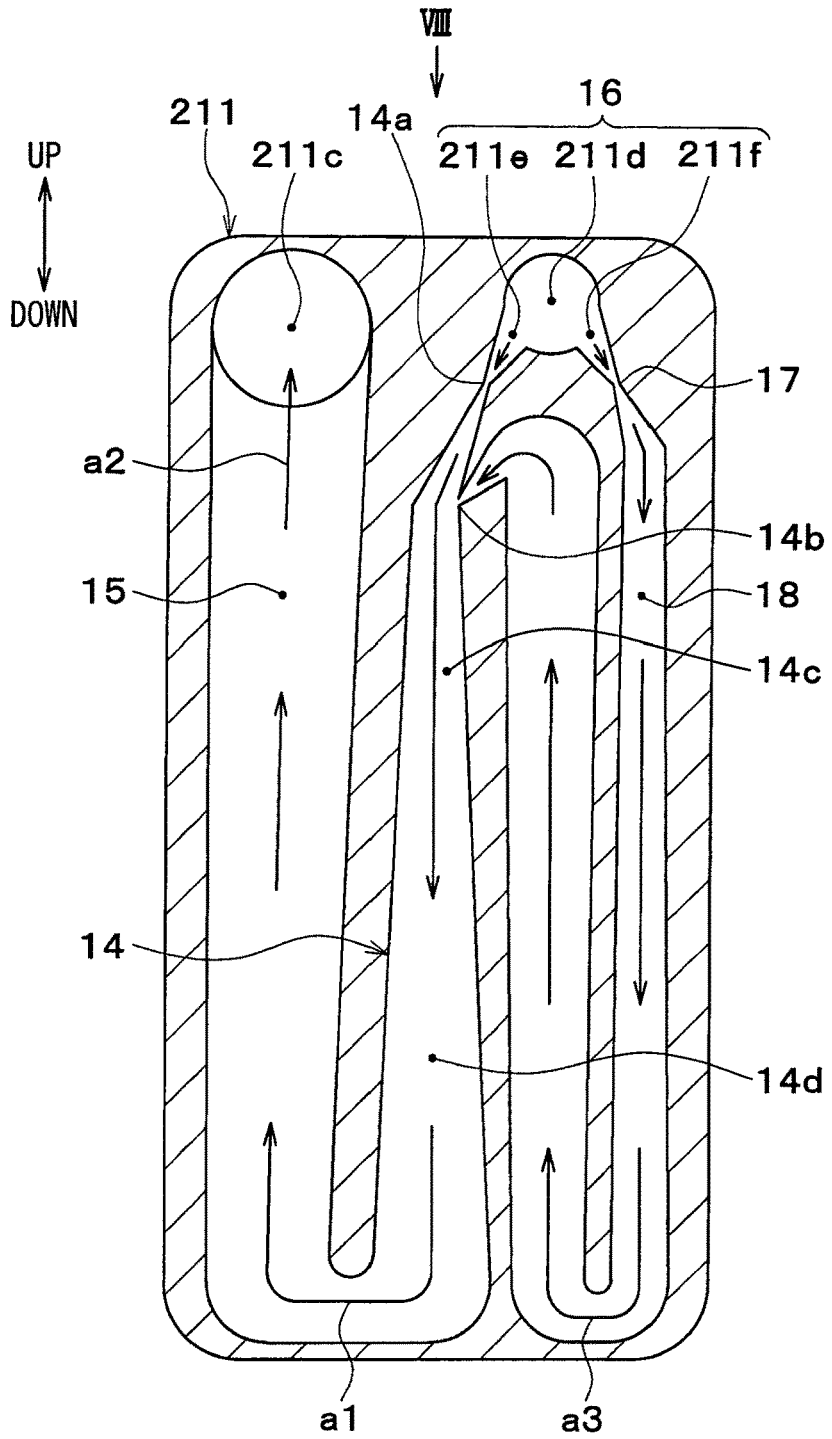
FIG. 7 is a sectional diagram illustrating a tube forming member according to a second embodiment of the present disclosure.

An inlet tank hole 211*d* and an outlet tank hole 211*c* are formed in one end portion (upper end portion in FIG. 7) of a holed member 211 in a longitudinal direction. The inlet tank hole 211*d* is an inlet space into which a refrigerant flows. The outlet tank hole 211*c* is an outlet space from which the refrigerant flows.

The holed member 211 includes a nozzle side communication passage 211*e* that causes the inlet tank hole 211*d* and a nozzle portion 14*a* to communicate with each other, and a suction side communication passage 211*f* that causes the inlet tank hole 211*d* and a throttle device 17 to communicate with each other. Accordingly, the inlet tank hole 211*d* is communicated with the nozzle portion 14*a* and the throttle device 17, and an outlet tank hole 211*c* is communicated with a flow-out side refrigerant passage 15.

A refrigerant distributor 16 is constituted by the inlet tank hole 211*d*, the nozzle side communication passage 211*e*, and the suction side communication passage 211*f*.

The nozzle side communication passage 211*e* and the suction side communication passage 211*f* extend obliquely downward from the inlet tank hole 211*d*.

Figure 8:
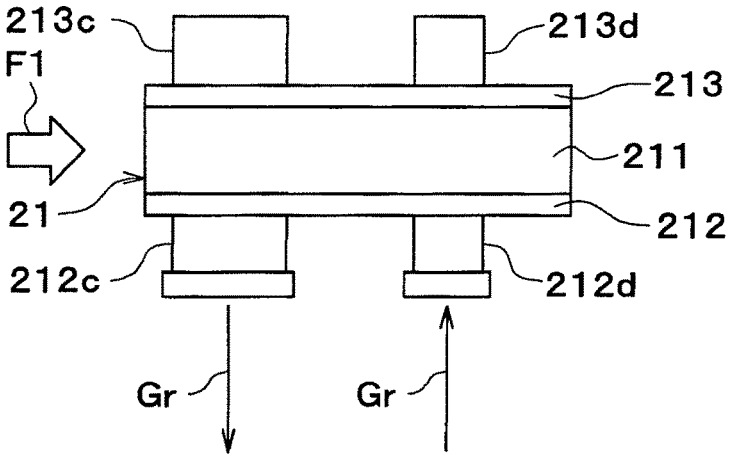
FIG. 8 is a diagram illustrating the tube forming member viewed along an arrow VIII of FIG. 7.
Figure 9:
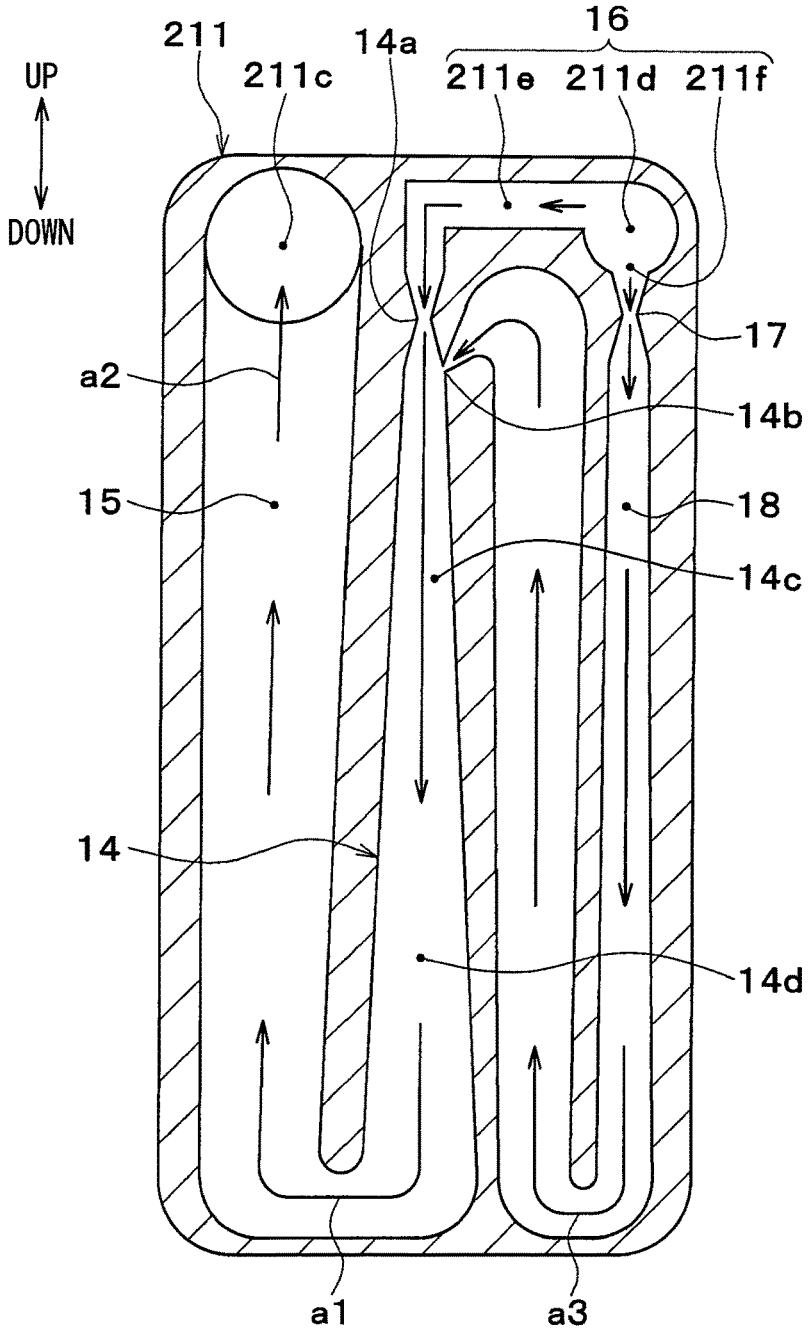
FIG. 9 is a sectional diagram illustrating a tube forming member according to a third embodiment of the present disclosure.

As shown in FIG. 8, the closing members 212, 213 include inlet side pipe portions 212*d*, 213*d* and outlet side pipe portions 212*c*, 213*c* each of which protrudes and has a pipe shape.

The pipe portions 212*d*, 213*d*, 212*c*, 213*c* are formed by burring and integrated with the closing members 212, 213.

End portions of the pipe portions 212*d*, 212*c* and the closing member 212 are enlarged. The pipe portions 213*d*, 213*c* of the closing member 213 are inserted into and bonded to the enlarged ends of the pipe portions 212*d*, 212*c*. Accordingly, the pipe portions 212*d*, 213*d*, 212*c*, 213*c* work as connection portions that connect tube forming members 21 next to each other.

The inlet side pipe portions 212*d*, 213*d* overlap the inlet tank hole 211*d* of the holed member 211. Accordingly, the inlet side pipe portion 212*d* works as a communication portion that causes the inlet tank holes 211*d* of the tube forming members 21 next to each other to communicate with each other.

The inlet side pipe portion 212*d* and the inlet tank hole 211*d* constitute a distribution tank that distributes the refrigerant to the nozzle portion and the throttle device 17 of the ejector 14 of each tube forming member 21.

According to the present embodiment, only one refrigerant inlet and only one refrigerant outlet are provided in the evaporator 20 as a whole.

In the present embodiment, the tube forming member 21 includes the inlet space 211*d* into which the refrigerant flows, the nozzle side communication passage 211*e* that causes the inlet space 211*d* and the nozzle portion 14*a* to communicate with each other, and the suction side communication passage 211*f* that causes the inlet space 211*d* and the suction side refrigerant passage 18 to communicate with each other.

According to this, since the refrigerant distributor 16 that distributes the refrigerant to the nozzle portion 14*a* and the suction side refrigerant passage 18 can be integrated with the tube forming member 21, the number of components can be reduced, and accordingly the configuration of the refrigeration cycle can be simplified.

(Third Embodiment)

In the second embodiment, the nozzle side communication passage 211*e* and the suction side communication passage 211*f* extend obliquely downward from the inlet tank hole 211*d*. In the present embodiment, the nozzle side communication passage 211*e* extends in a horizontal direction from the inlet tank hole 211*d*, and the suction side communication passage 211*f* extends vertically downward from the inlet tank hole 211*d*.

In other word, the nozzle side communication passage 211*e* is located in an upper side compared to the suction side communication passage 211*f* in the gravity direction.

According to this, the refrigerant flowing into the inlet tank hole 211*d* (the refrigerant that has passed the thermostatic expansion valve 13) can be separated, by gravity, into a gas-liquid two-phase refrigerant flowing toward the nozzle portion 14*a* of the ejector 14 and a liquid-phase refrigerant flowing toward the throttle device 17.

In the present embodiment, the nozzle side communication passage 211*e* is located upward of the suction side communication passage 211*f* in a gravity direction. Accordingly, the refrigerant can be separated into the gas-liquid two-phase refrigerant flowing toward the nozzle portion 14*a* and the liquid-phase refrigerant flowing toward the suction side refrigerant passage 18 by gravity.

(Fourth Embodiment)

Figure 10:
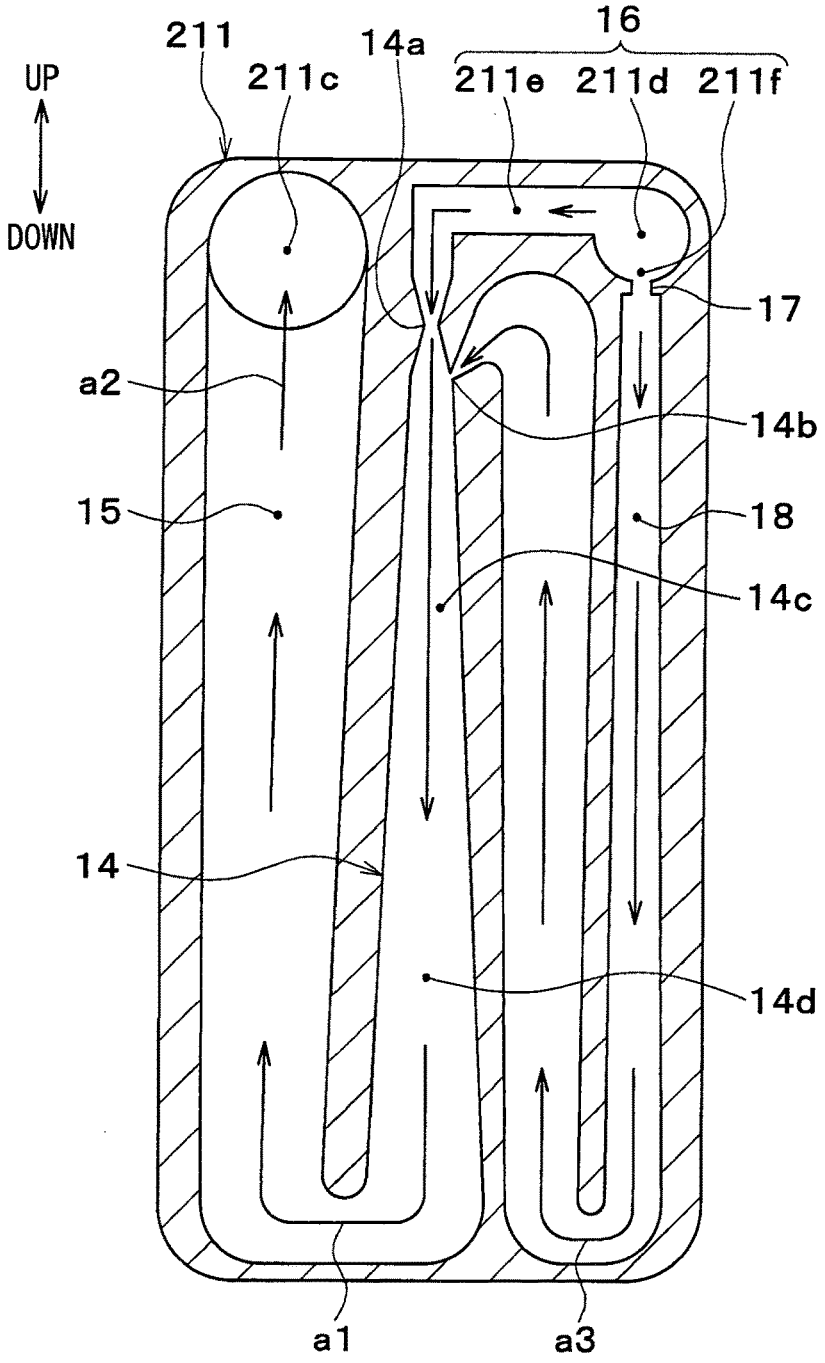
FIG. 10 is a sectional diagram illustrating a tube forming member according to a fourth embodiment of the present disclosure.

In the above-described embodiments, the throttle device 17 has a nozzle shape, but the throttle device 17 may have an orifice shape as shown in FIG. 10. The throttle device 17 may have a capillary shape.

(Fifth Embodiment)

Figure 11:
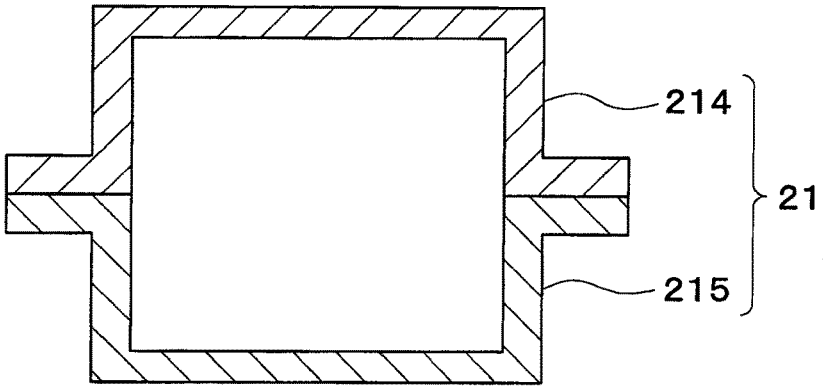
FIG. 11 is a sectional diagram illustrating a tube forming member according to a first example of a fifth embodiment of the present disclosure.
Figure 12:
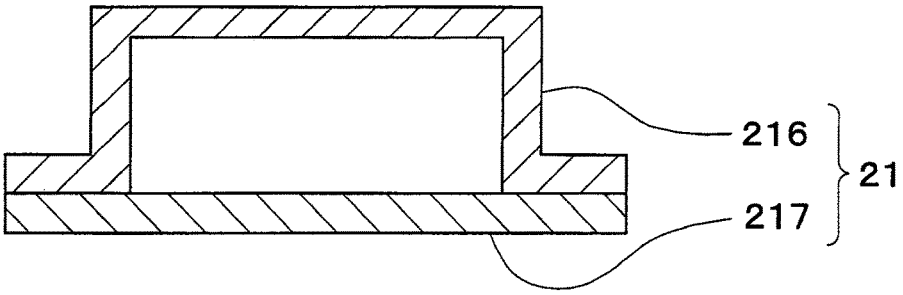
FIG. 12 is a sectional diagram illustrating a tube forming member according to a second example of the fifth embodiment.
Figure 13:
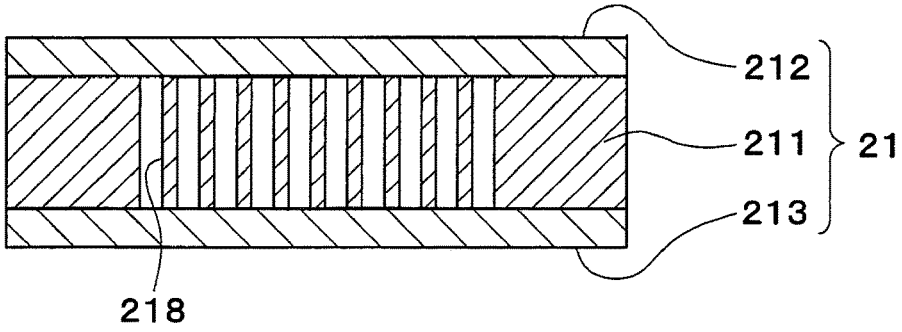
FIG. 13 is a sectional diagram illustrating a tube forming member according to a third example of the fifth embodiment.

In the above-described embodiments, the tube forming member 21 is formed by stacking and bonding the holed member 211 and the closing members 212, 213 to each other, but the tube forming member 21 may be formed as shown in FIGS. 11, 12, 13.

In an example illustrated in FIG. 11, the tube forming member 21 is formed by stacking and bonding two forming members 214, 215 to each other. In the forming member 214, 215, the ejector 14, the flow-out side refrigerant passage 15, the throttle device 17 and the suction side refrigerant passage 18 are formed by pressing.

In an example illustrated in FIG. 12, the tube forming member 21 is formed by stacking and bonding one forming member 216 and one overlapping member 217 that has a plate shape. In the forming member 216, the ejector 14, the flow-out side refrigerant passage 15, the throttle device 17 and the suction side refrigerant passage 18 are formed by pressing.

In an example illustrated in FIG. 13, an inner fin 218 is provided in the flow-out side refrigerant passage 15 and the suction side refrigerant passage 18. The inner fin 218 is a heat exchange enhancing member that enhances heat exchange between the refrigerant and air. The inner fin 218 has a thin platy shape that is connected to a flat inner surface of the tube forming member 21 and enlarges an air side heat transfer area.

(Sixth Embodiment)

Figure 14:
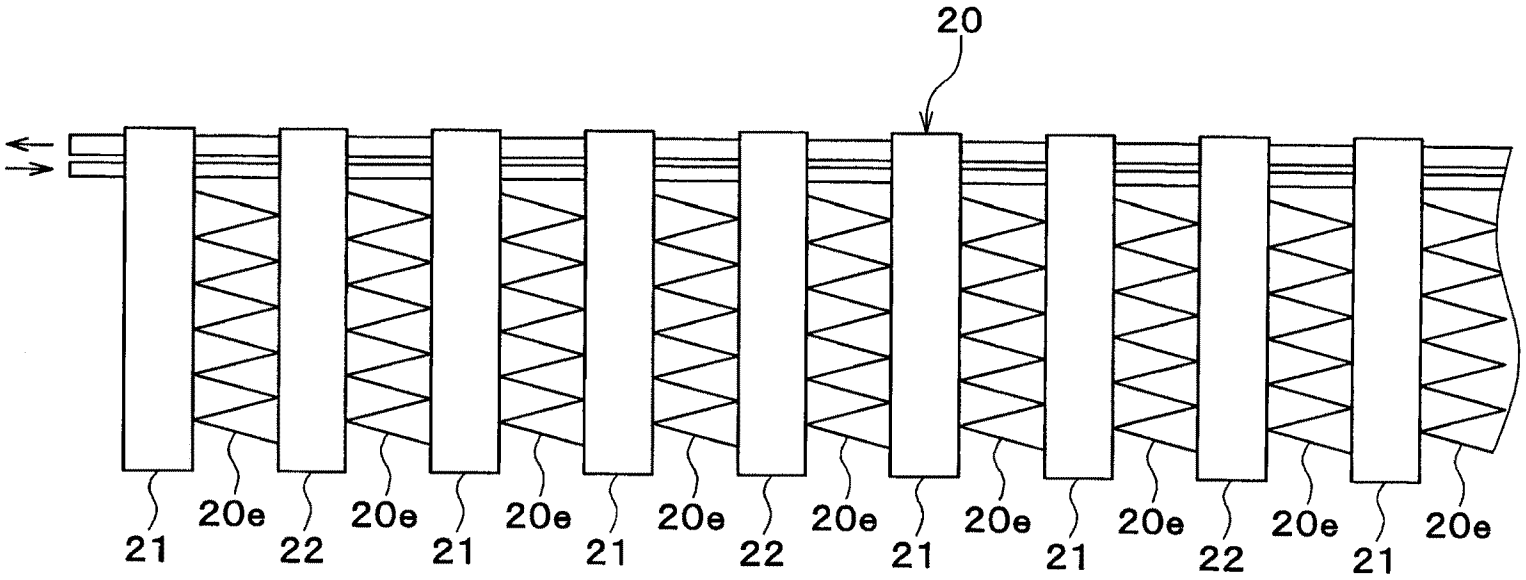
FIG. 14 is a front elevation view illustrating an evaporator according to a sixth embodiment of the present disclosure.

In the present embodiment, as shown in FIG. 14, a cold storage package 22 is provided between multiple tube forming members 21. The cold storage package 22 is a non-tube forming member (second member) that is different from the tube forming member 21. The cold storage package 22 is connected with the tube forming member 21 through a fin 20*e*. The cold storage package 22 is a cold storage member that stores a cold heat of the refrigerant flowing in the evaporator 20.

The cold storage package 22 includes a cold storage material and a cold storage material container. The cold storage material is paraffin, for example. The cold storage material may be sodium acetate hydrate. The cold storage material container accommodates the cold storage material. An outer shape of the cold storage material container is similar to that of the tube forming member 21. Aluminum that is superior in heat conduction and preferable in brazing is preferable for material of the cold storage material container. When the cold storage material container is made of aluminum, an entire structure of the evaporator 20 can be formed by brazing.

The cold storage material container of the cold storage package 22 includes a refrigerant communication hole that provides liquid communication between the tube forming members 21 next to each other.

The cold heat of the refrigerant flowing in the tube forming member 21 is transferred to the cold storage material of the cold storage package 22 through the tube forming member 21, the fin 20*e*, and the cold storage material container of the cold storage package 22. Accordingly, the cold storage material stores the cold heat of the refrigerant flowing in the evaporator 20.

In the present embodiment, multiple tube forming members 21 and multiple cold storage members 22 are stacked with each other. According to this, since the cold heat of the refrigerant can be stored in the cold storage member 22, the evaporator 20 is capable of storing the cold heat.

In the present embodiment, the cold storage member 22 is connected to the tube forming member 21 through the fin 20*e*. According to this, since the cold heat of the refrigerant can be effectively stored in the cold storage member 22, cold storage property of the evaporator 20 can be improved.

(Seventh Embodiment)

Figure 15:
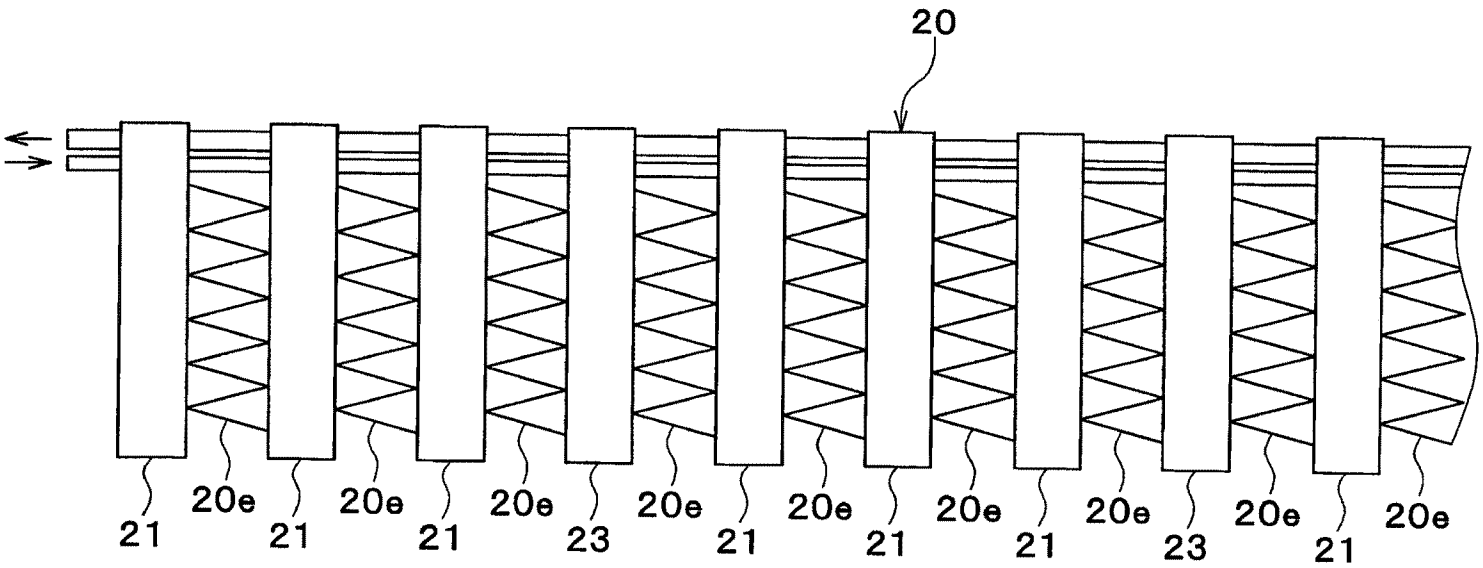
FIG. 15 is a front elevation view illustrating an evaporator according to a seventh embodiment of the present disclosure.

In the present embodiment, as shown in FIG. 15, reinforcing members 23 are provided between multiple tube forming members 21. The reinforcing member 23 is a non-tube forming member (second member) that is different from the tube forming member 21. The reinforcing member 23 is connected to the tube forming member 21 through the fin 20*e*. The reinforcing member 23 is a member for strengthen the evaporator 20.

The reinforcing member 23 is a stiffness member having higher stiffness than the tube forming member 21. The reinforcing member 23 is connected to the tube forming member 21 through the fin 20*e*.

The reinforcing member 23 has an outer shape similar to the tube forming member 21. Aluminum that is a metal superior in thermal conductivity and a property for brazing is preferable as a material of the reinforcing member 23. When the reinforcing member 23 is formed of aluminum, the whole structure of the evaporator 20 can be integrally formed by brazing. A part of the reinforcing member 23 may have a hollow shape.

The reinforcing member 23 includes a refrigerant communication hole that provides a refrigerant communication between the tube forming members 21 positioned on both sides of the reinforcing member 23.

In the present embodiment, multiple tube forming members 21 and multiple reinforcing members 23 are stacked with each other. According to this, since the evaporator 20 can be strengthened, a property in silence can be improved.

In the present embodiment, the reinforcing member 23 is connected to the tube forming member 21 through the fin 20*e*. According to this, since the evaporator 20 is surely strengthened, a property in silence can be surely improved.

The above-described embodiments can be combined with each other. The above-described embodiments can be modified as described below, for example.

In the above-described embodiments, the evaporator 20 includes the ejector 14, and the first and second evaporation passages 15, 18 integrally, but the evaporator 20 may include other components constituting the ejector refrigeration cycle integrally. For example, the thermostatic expansion valve 13 and the thermostatic portion 13*a* may be integrated with the evaporator 20.

In the above-described embodiments, when the components of the evaporator 20 are integrated with each other, the components are integrated by brazing. However, this integration of the components may be performed by screwing, swaging, welding, bonding, for example, instead of brazing.

In the above-described embodiments, the vapor-compression subcritical cycle is described, in which chlorofluorocarbon or hydrocarbon refrigerant that is not excess a critical pressure even in a high-pressure part is used as the refrigerant. However, the refrigerant that can excess the critical pressure in the high-pressure part such as carbon dioxide may be used.

In the above-described embodiments, the evaporator 20 is used as an interior heat exchanger, and the radiator 12 is used as an exterior heat exchanger that dissipates heat to atmosphere. However, the present disclosure may be used in a heat pump cycle in which the evaporator 20 is an exterior heat exchanger absorbing heat from a heat source such as atmosphere, and the radiator 12 is an interior heat exchanger heating a heating object fluid such as air or water.

In the above-described embodiments, the refrigeration cycle for a vehicle is described. However, it is needless to say that the present disclosure can be used in a stationary refrigeration cycle.

Although the present disclosure has been described in connection with the preferred embodiments thereof, it is to be noted that various changes and modifications will become apparent to those skilled in the art. The present disclosure includes various changes and modifications within the equivalent. Moreover, other combinations and configurations, including more, less or only a single element, are also within the spirit and scope of the present disclosure.

What is claimed is:

1. An ejector-integrated heat exchanger comprising:

a plurality of tube forming members each including an ejector that includes a nozzle portion that decompresses a refrigerant, a refrigerant suction port, the refrigerant being drawn through the refrigerant suction port due to a refrigerant flow jetted from the nozzle portion, and a pressure increasing portion in which the refrigerant drawn from the refrigerant suction port and the refrigerant jetted from the nozzle portion are mixed, a pressure of the mixed refrigerant being increased in the pressure increasing portion, a flow-out side refrigerant passage in which the refrigerant flowing out of the pressure increasing portion performs heat exchange while flowing, and a suction side refrigerant passage in which the refrigerant that is to be drawn through the refrigerant suction port performs heat exchange while flowing, wherein the plurality of tube forming members are arranged such that the refrigerant in the plurality of tube forming members flows in parallel with each other.

2. The ejector-integrated heat exchanger according to claim 1, wherein the plurality of tube forming members includes an inlet space into which the refrigerant flows, a nozzle side communication passage through which the inlet space is communicated with the nozzle portion, and a suction side communication passage through which the inlet space is communicated with the suction side refrigerant passage.

3. The ejector-integrated heat exchanger according to claim 2, wherein the nozzle side communication passage is located upward of the suction side communication passage in a gravity direction.

4. The ejector-integrated heat exchanger according to claim 1, wherein a cross-sectional area of at least one of the flow-out side refrigerant passage and the suction side refrigerant passage is increased toward a downstream side of the refrigerant.

5. The ejector-integrated heat exchanger according to claim 1, further comprising:

a pipe portion provided in each of mutually adjacent pairs of the plurality of tube forming members and defining a refrigerant passage between the mutually adjacent pairs of tube forming members, wherein the pipe portion provided in one of the pair of mutually adjacent tube forming members includes an end portion that has an expanded pipe shape, and the pipe portion provided in another of the pair of the plurality of tube forming members is inserted into the end portion having the expanded pipe shape.

6. The ejector-integrated heat exchanger according to claim 1, wherein the plurality of tube forming members include a throttle device that throttles a flow of the refrigerant flowing into the suction side refrigerant passage, and the throttle device has a nozzle shape.

7. The ejector-integrated heat exchanger according to claim 1, wherein the plurality of tube forming members include the ejector between the flow-out side refrigerant passage and the suction side refrigerant passage.

8. The ejector-integrated heat exchanger according to claim 1, wherein the plurality of tube forming members include a holed member that has a plate shape and includes a hole corresponding to the ejector, the flow-out side refrigerant passage, and the suction side refrigerant passage, and a closing member that closes the hole of the holed member from both sides of the holed member.

9. The ejector-integrated heat exchanger according to claim 1, wherein the plurality of tube forming members includes a shape corresponding to the flow-out side refrigerant passage and the suction side refrigerant passage which is formed by two press-formed forming members that are stacked and bonded with each other.

10. The ejector-integrated heat exchanger according to claim 1, wherein the plurality of the tube forming members are formed from a forming member and an overlapping member which are stacked and bonded with each other, and the forming member includes a part formed by pressing and corresponding to the flow-out side refrigerant passage and the suction-side refrigerant passage, the shape being formed by pressing.

11. The ejector-integrated heat exchanger according to claim 1, wherein the plurality of tube forming members include an inner fin provided in the flow-out side refrigerant passage and the suction side refrigerant passage, the inner fin enhancing the heat exchange of the refrigerant.

12. The ejector-integrated heat exchanger according to claim 1, further comprising:

a second member different from a first member, wherein the plurality of tube forming members are the first member, and the first member and the second member are stacked with each other.

13. The ejector-integrated heat exchanger according to claim 12, wherein the second member is a cold storage member that stores cold heat.

14. The ejector-integrated heat exchanger according to claim 13, wherein the cold storage member is connected to the first member through a heat exchange enhancing member that enhances the heat exchange of the refrigerant.

15. The ejector-integrated heat exchanger according to claim 12, wherein the second member is a reinforcing member that has a higher stiffness than the first member.

16. The ejector-integrated heat exchanger according to claim 15, wherein the reinforcing member is connected to the first member through a heat exchange enhancing member that enhances the heat exchange of the refrigerant.

* * * * *